United States Patent [19]

Zogas

[11] 4,083,350

[45] Apr. 11, 1978

[54] DIAMOND GRINDING WHEEL PRECISION CONVEX RADII DRESSING APPARATUS

[76] Inventor: George V. Zogas, 1514 W. Hawthorne, Arlington Heights, Ill. 60005

[21] Appl. No.: 745,659

[22] Filed: Nov. 29, 1976

[51] Int. Cl.[2] ..... B24B 53/06

[52] U.S. Cl. ..... 125/11 CP; 125/11 N; 125/11 A

[58] Field of Search ..... 125/11 R, 11 N, 11 CD, 125/11 AT, 11 A

[56] References Cited

U.S. PATENT DOCUMENTS

| | | | |
|---|---|---|---|
| 491,789 | 2/1893 | Walker | 125/11 N |
| 1,649,713 | 11/1927 | Lofquist | 125/11 CD |
| 2,642,856 | 6/1953 | Calloway | 125/11 AT |
| 3,678,915 | 7/1972 | Kikuchi | 125/11 CD |

*Primary Examiner*—Harold D. Whitehead
*Attorney, Agent, or Firm*—Darbo & Vandenburgh

[57] ABSTRACT

A tube is mounted with the top of one end in contact with the wheel. The lower part of that tube end is aligned to contact a stop. The tube is urged toward the stop and rotated about its longitudinal axis. With the grinding wheel rotating, the contact of the top edge of the tube with the wheel breaks diamonds from the wheel. When the tube idles against the stop a precise size has been achieved.

7 Claims, 3 Drawing Figures

Fig. 1.
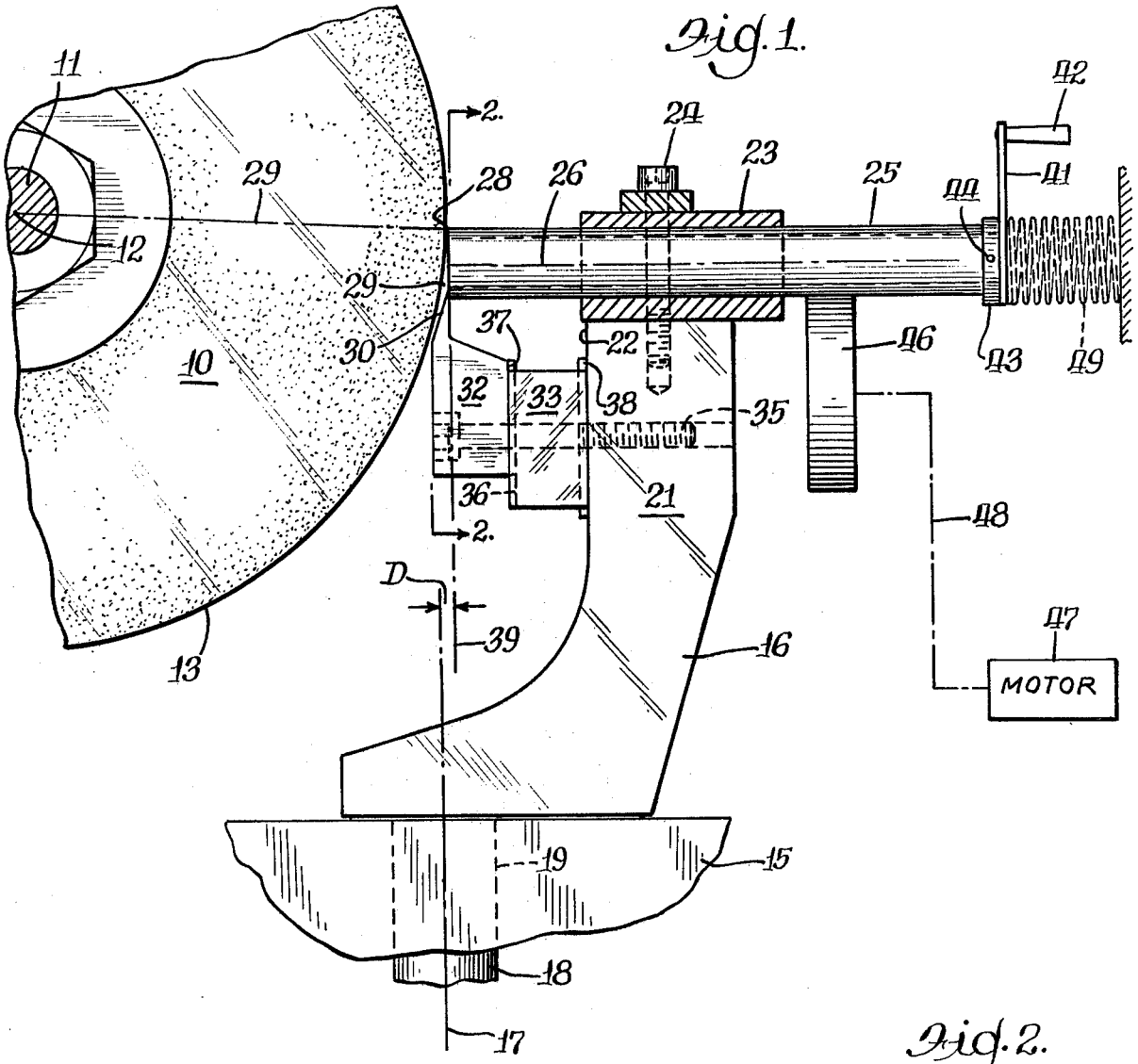
Fig. 2.
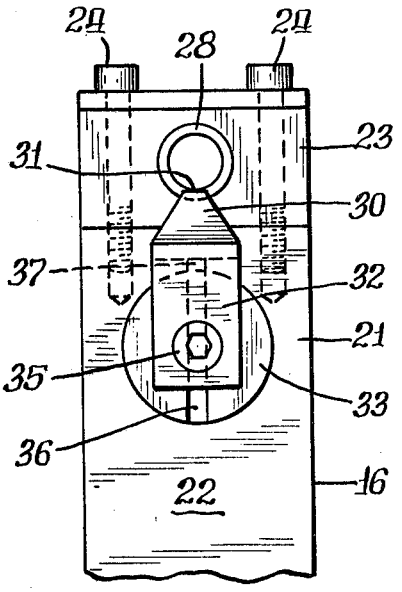
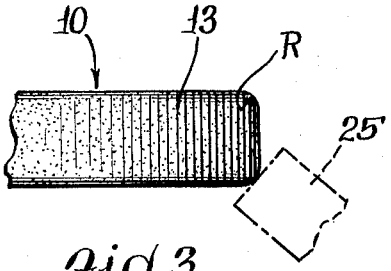
Fig. 3.

DIAMOND GRINDING WHEEL PRECISION CONVEX RADII DRESSING APPARATUS

BACKGROUND AND SUMMARY OF THE INVENTION

Diamond grinding wheels are commonly used for shaping hard materials such as carbide tools. These wheels comprise particles of diamonds held together by a matrix material such as a resin binder. With many of the shapes desired for the carbide tools it is necessary that the grinding wheel have its periphery formed to a particular shape. The principal object of the present invention is to provide an apparatus by which a desired shape can be given to the periphery of a diamond wheel.

Numerous devices are available for shaping the periphery of grinding wheels formed of a refractory abrasive, such as Carborundum. In the main, the forming tool of such devices is a diamond. Since the diamond is harder than the refractory abrasive it acts to remove portions of the refractory abrasive from the periphery of the rotating wheel and the periphery of the wheel is thereby given the desired configuration. However, with a diamond wheel the diamonds on the wheel are just as hard as the diamond cutting tool and present much more surface area. Thus the cutting tool is abraded away before any significant amount of shaping is done to the grinding wheel. So far as I am aware, there is no apparatus presently available on the market for shaping a diamond grinding wheel and such shaping, when it is done, is performed as a hand operation. In such hand operation, diamond particles about the periphery of the wheel are broken away, nearly one at a time, until the whole of the periphery of the wheel has been so shaped. Not only is this a slow operation, and therefore expensive in terms of the workman's time involved, but it is tedious and it is nearly impossible to have all of the circumference of the wheel exactly the same configuration.

I have discovered that if the cutting tool is in the form of a tube and a part of the end of the tube is positioned in contact with the periphery of the wheel, approximately transverse to a tangent to the wheel, the contact between that part of the tube and the rotating wheel will break the diamonds away by destroying the bond of the matrix holding the diamonds together. This occurs even though the material of the tube is quite soft as compared to the hardness of the diamonds of the wheel. This is not to say that the tube is not abraded, but in my invention the tube is rotated about its longitudinal axis and the final position of the end of the tube is always fixed by contact with a stop which bears against another part of the end of the tube.

Further features and advantages of my invention may be determined from the subsequent description thereof herein.

DESCRIPTION OF THE DRAWING

FIG. 1 is an elevational view, partially in section and partially diagrammatic, of an embodiment of my invention illustrating the manner in which it is used in dressing a diamond grinding wheel;

FIG. 2 is a partial elevational view as seen at line 2—2 of FIG. 1; and

FIG. 3 is a view of a portion of the periphery of a diamond grinding wheel illustrating the manner in which the corners of the wheel are shaped utilizing the embodiment of FIG. 1.

DESCRIPTION OF THE SPECIFIC EMBODIMENT

The following disclosure is offered for public dissemination in return for the grant of a patent. Although it is detailed to ensure adequacy and aid understanding, this is not intended to prejudice that purpose of a patent which is to cover each new inventive concept therein no matter how others may later disguise it by variations in form or additions or further improvements.

FIGS. 1 and 3 illustrate a diamond grinding wheel, generally 10. This wheel is secured to a shaft 11. The shaft is mounted in an arbor, not shown, which permits it to be rotated about an axis 12. Suitable power means, not shown, is connected to shaft 11 to so rotate the wheel. The wheel has a periphery 13. For the purposes of illustration, it will be assumed that it is desired to form the edges of the periphery 13 so that they have a radius R as seen in FIG. 3.

Like many of the conventional dressing devices for wheels formed of a refractory abrasive material, the apparatus includes a base 15. A support member 16 is mounted on this base for pivotal movement about a forming axis 17. To this end the support member 16 has an integral post 18 which is received in a socket 19 in the base 15. Both the post and socket are of circular configuration about forming axis 17.

In the illustrated embodiment of my invention, the support member includes an upright post 21. It has a face 22 which is parallel to forming axis 17. A bearing 23 is secured to the top of the post by cap screws 24 threaded into the post. A hollow tube 25 is journaled in bearing 23, both for movement rotationally of the tube axis 26 and also longitudinally thereof.

The tube is positioned so that the top part 28 thereof contacts the wheel and is generally transverse to a tangent to the periphery of the wheel. This contact occurs at a radius 29 about the rotational axis 12, which radius is approximately parallel to the axis 26 of the tube. The positioning of the tube is such that there is a space 29 between the remainder of the end of the tube and the periphery of the wheel. A stop in the form of a finger 30 projects into this space so that it will be contacted by the lower part 31 of the end of the tube. The finger is integral with a mounting member 32. The mounting member abuts a gage block 33 which in turn abuts face 22 of the support member. A cap screw 35 extends through openings in mounting member 32 and gage block 33 and is threaded into post 21. To assist in holding the finger 30 in the desired position, in some embodiments the gage block will have a slot 36 on each face thereof to receive projections 37 and 38 on mounting member 32 and post 21 respectively. Thus in such embodiments, the mounting member 32 is not free to rotate about cap screw 35.

A series of gage blocks 33 will be used alternatively. Each block is of a different thickness, as measured axially of bolt 35. Thus, the operator can select a block of suitable thickness to achieve the desired dimension D, which is the distance between forming axis 17 and the stop face of the finger 30. In the illustrated embodiment the line 39 is parallel to axis 17 and extends along the stop face of the finger 30, where that stop face is contacted by end 31 of the tube 25. A gage block 33 (or a plurality of blocks) is selected to have a thickness such that the dimension D will correspond to the desired radius R for the corners of the wheel.

Means are provided for rotating tube 25 and urging it toward the wheel and stop. Two such means are illustrated in FIG. 1, however, in various embodiments only one of these may be employed. For manual operation a crank 41 may be used. The crank has a handle 42 secured to one end and a collar 43 secured to the other. Tube 25 slips within the collar 43 and the two are joined as by means of a pin 44. By grasping the handle 42, the operator may rotate the tube 25 and at the same time urge it toward the wheel, to the left as viewed in FIG. 1. For power rotation a rotatably mounted rubber drive wheel 46 frictionally engages tube 25. The drive wheel is rotated by an electric motor 47, as indicated by dashed line 48. Alternatively a belt drive might be used on a pulley secured to the tube. A spring is employed to urge the tube 25 toward the grinding wheel and stop. This is diagrammatically illustrated in FIG. 1 by means of a compression spring 49 bearing against the end of the tube and a suitable immovable abutment.

Preferably the tube is rotated at a speed of about 200–300 RPM. This may be difficult to perform manually. If the tube is being rotated manually, the operator should endeavor to rotate the tube at about the maximum speed that can be maintained. This is done, of course, while the grinding wheel is rotating at its usual speed. During the operation the operator grasps support member 16 and turns it slowly back and forth about its forming axis 17. When the top part 28 of the tube no longer contacts the periphery of the wheel, the operator knows that the correct radius R has been realized. Upon dressing a corner in the manner described, it is possible to achieve an accuracy of two ten-thousandths of an inch in the radius R about the periphery of the wheel. This is an accuracy far greater than anything that can be achieved utilizing presently available procedures of which I am aware.

The material of which the tube 25 is made is not critical to the invention. Of course, the harder the material is, the slower it will be abraded on the end contacting the grinding wheel. The tube may, for example, be mild steel. I have obtained excellent results using a high-carbon, high-chrome, soft steel.

I claim:

1. In an apparatus for dressing a grinding wheel having a periphery which is to be dressed to a given dimension and rotating about an axis and comprising particulate diamonds held together by a bonding material, said apparatus comprising a tool and a device for mounting said tool in contact with said wheel, the improvement comprising:

said tool comprising an elongate member formed about an axis and having an end, said member being formed of a material softer than said diamonds;

said device positioning a first part only of said end in contact with said periphery and including means mounting said member for rotation about said member axis and for resiliently urging said member longitudinally of said member axis toward said wheel, said rotation of said member maintaining said end generally planar and in a plane substantially normal to said member axis; and including means engaging said member for rotating said member about its axis and a stop positioned to contact a second part of said end after said member is moved toward said periphery to an extent such that said periphery is reduced to said given dimension, said second part being spaced from said part contacting said periphery, said stop being positioned so that initially said end of said member does not contact the stop but contacts the wheel periphery which holds the end away from the stop but when said wheel has been dressed to said given dimension said second part will contact with said stop and thereby said first part will be at the location at which it will no longer effectively bear against said wheel, whereby said stop limits the movement of said member toward the axis of the wheel when said given dimension has been achieved.

2. In an apparatus as set forth in claim 1, wherein said member is tubular about said member axis, and said means resiliently urges said member against said stop.

3. In an apparatus as set forth in claim 2, wherein said member is annular.

4. In an apparatus as set forth in claim 3, wherein said device includes a post having a face parallel to said forming axis; and said last mentioned means includes said stop having a mounting member integral therewith, a gage block between said mounting member and said face, and means releasably holding said mounting member against said gage block and said gage block against said face.

5. In an apparatus as set forth in claim 3 and wherein the device permits movement of the tool about a forming axis which lies in a plane normal to the wheel axis, the further improvement wherein said device comprises:

means for adjustably positioning said stop with respect to said forming axis.

6. In an apparatus as set forth in claim 5, wherein the member axis is positioned substantially parallel to a radius of said wheel.

7. In an apparatus as set forth in claim 1 and wherein a corner of the diamond wheel is to be dressed to a given radius, and wherein said device includes a base and a support member mounted on the base for pivotal movement about a forming axis, the further improvement comprising:

said stop and said means for mounting said elongate member being secured to said support member, said stop being positioned a distance from said forming axis which distance is equal to said radius.

* * * * *